US006612242B2

(12) United States Patent
Raupp et al.

(10) Patent No.: US 6,612,242 B2
(45) Date of Patent: Sep. 2, 2003

(54) AMMUNITION FOR SMOKE GENERATION

(75) Inventors: Karl Raupp, Neuenburg (DE); Werner Brand, Worben (CH); Hansjörg Lang, Auggen (DE); Wolfgang Kukla, Babenhausen (DE)

(73) Assignee: Buck Neue Technologien GmbH, Neuenburg (DE)

( * ) Notice: Subject to any disclaimer, the term of this patent is extended or adjusted under 35 U.S.C. 154(b) by 0 days.

(21) Appl. No.: 10/032,799

(22) Filed: Dec. 26, 2001

(65) Prior Publication Data

US 2003/0097950 A1 May 29, 2003

(30) Foreign Application Priority Data

Dec. 27, 2000 (DE) ..... 100 65 816

(51) Int. Cl.[7] ..... F42B 12/48

(52) U.S. Cl. ..... 102/334; 102/336; 102/342; 102/351; 102/357

(58) Field of Search ..... 102/334, 336, 102/342, 351, 357, 358

(56) References Cited

U.S. PATENT DOCUMENTS 2,961,962 A * 11/1960 Jackson ..... 102/336
3,625,152 A * 12/1971 Schneider et al. ..... 102/269
3,713,636 A * 1/1973 Helms et al. ..... 266/71
4,324,183 A 4/1982 Prahauser et al.
4,353,301 A 10/1982 Jacobsen
4,624,186 A * 11/1986 Widera et al. ..... 102/336
4,700,628 A 10/1987 Varmo
4,860,657 A * 8/1989 Steinicke et al. ..... 102/334
5,337,671 A * 8/1994 Varmo ..... 102/334
5,499,582 A * 3/1996 Schiessl et al. ..... 102/334
5,585,594 A * 12/1996 Pelham et al. ..... 102/336
5,817,969 A * 10/1998 Ettmuller ..... 102/489

FOREIGN PATENT DOCUMENTS

DE 28 41 815 6/1980

* cited by examiner

*Primary Examiner*—Peter A. Nelson
(74) *Attorney, Agent, or Firm*—Burns, Doane, Swecker & Mathis, LLP

(57) ABSTRACT

The present invention relates to a cartridge for smoke generation for the protection of combat vehicles, wherein the shell has the form of an integral two-chamber double can (2) including a partition wall shared by both chambers (10), the wall thickness of the partition wall (10) being greater than the wall thickness of the double can outer wall (22), and the front end of the double can (2) being closed gas-tight.

27 Claims, 1 Drawing Sheet

AMMUNITION FOR SMOKE GENERATION

BACKGROUND OF THE INVENTION

The present invention relates to an ammunition for smoke generation for the protection of combat vehicles.

It is known to protect combat vehicles, in particular tanks, in combat missions by means of pyrotechnical smokes and also by means of combined pyrotechnical/infrared-emitting smokes. This protection on the one hand covers the visual range so as to withdraw a combat vehicle from direct observation and from being targeted. On the other hand, the protection also encompasses warding off, e.g., infrared-guided homing missiles.

From the prior art, e.g. from U.S. Pat. No. 4,700,628, there is known a smoke grenade consisting of a pyrotechnical smoke generator and an infrared smoke generator. This grenade is launched from the vehicle to be protected and ignited at a defined distance from the combat vehicle to be protected. A smoke screen then forms which lasts for several seconds. A second part of the grenade includes the infrared smoke active mass which drops to the ground as a smoke cup and forms an infrared smoke.

It is, however, a drawback in this prior-art smoke grenade that the infrared smoke cup released upon separation of the grenade must land on the ground in a defined position and only then generates its infrared smoke. If it drops with the opening facing down, for example, it will hardly release any smoke.

Another smoke-generating projectile is known from DE 28 418 15 C2 and from U.S. Pat. No. 4,324,183.

Smoke grenades containing several different charges for the protection of combat vehicles are moreover known from U.S. Pat. No. 4,353,301.

In accordance with this prior art, a can-shaped container includes in its lower portion a discharge composition which is initiated by an ignition composition for igniting a detonation separator charge, which in turn ignites a flammable smoke active mass preferably having a disc shape. In front of the first flammable smoke charge when viewed in the direction of the projectile's trajectory, another smoke charge is mounted which is more compact and therefore is ignited more slowly than the first smoke active mass. It is moreover known to combine smoke active masses and infrared-flare active masses in smoke grenades. In accordance with this prior art, a cup containing the active masses is rolled up inside a can and sealed by means of sealant. To this end several components are necessary, resulting in comparatively high material costs and costly assembly.

It frequently is a drawback of this ammunition that leakages occur with temperature fluctuations due to the accumulation of different interfaces owing to an increased number of components, so that the ammunition may possibly not function reliably any more.

SUMMARY

It was therefore the object of the present invention to furnish an ammunition for generating a smoke for the protection of combat vehicles, which may be manufactured more cost-effectively and more reliably.

The ammunition for smoke generation for the protection of combat vehicles according to the invention includes a shell, at least one active mass arranged therein, at least one detonation separator charge, at least one ejection charge for ejecting the ammunition from a conventional launcher tube, and electrical contact means for igniting the ejection charge.

The shell of the ammunition in accordance with the invention has the form of an integral two-chamber double can having a partition wall shared by both chambers, wherein the wall thickness of the partition wall is greater than the wall thickness of the double can outer wall, and an end of the double can located in the direction of the launcher tube muzzle (front-side end) is closed gas-tight.

Due to the design as a double can, a more compact construction than with the construction of the prior art is possible, together the possibility of accommodating a larger quantity of active mass, and in turn results in enhanced efficiency.

In comparison with the prior art, savings may be realized in that for one thing, assembly is facilitated by the smaller number of required components. The ammunition of the invention moreover allows for higher functional safety because—as a result of a reduced number of components and thus less interfaces—it is less susceptible to disturbance factors such as leakages, temperature influences, strength properties. A smaller number of components to be assembled translates into a more simple production process and thus a reduced failure frequency.

The ammunition according to the invention may be designed for any customary smoke cartridge calibers, thus e.g. for the applicant's products which are being distributed under the trade name MASKE (German trade mark registered in the Applicant's name) for the calibers 66 mm, 76 mm and 81 mm.

With the ammunition of the invention it is possible to build, in less than a second, a complete infrared and visual smoke screen which is stable up to approximately one minute.

The ammunition of the invention preferably is a bimodal ammunition concept wherein in general a high-velocity flare distribution and components for sustained infrared and visual screening are contained in the ammunition as active masses.

The ammunition of the invention is effective against simultaneous attacks by several kinds of sensor-guided weapons and has in particular found to be effective for the protection of tanks.

In summary it can thus be stated that the ammunition of the invention is particularly suited for the protection of combat vehicles being threatened by:

optical and infrared observation optical and infrared aiming devices optical and infrared sensor-guided weapons laser illuminators and laser beam-guided weapons, as well as laser-supported range finders.

Further advantages of the present invention are the simple and quick assembly; the enhanced effectivity due to the accommodation of more active mass; less trained personnel is required for assembly; and the quality of overall manufacture may be controlled better inasmuch as less components are being used and less interfaces with required components are necessary than in the prior art, whereby the sources of errors thereof are accordingly eliminated. Easy adaptation to semi- and fully automatic production is possible.

The ammunition of the invention is a self-contained unit without any costly connecting technology as hitherto required in the prior art, and with markedly simplified sealing technology.

Preferably the double can is manufactured of aluminum.

Due to the double can design it is particularly advantageous to manufacture this double can of a metal, in particular aluminum metal, by extrusion.

As a preferred active mass of the ammunition, smoke-generating pressed bodies which are known per se, and flares which emit infrared radiation and are also known per se, are used as the active mass.

In a preferred embodiment of the present ammunition, the double can is sealed with an O-ring and closed with a lid on its front side. This has the advantage that prior-art sealing materials, which may be subjected to thermal variations and thus may produce leakages, are avoided, and there is no more need to allow time for the sealing material to cure out or complete reactions. Moreover O-rings are commercially available at low cost in all sizes, dimensions and desired materials.

Preferably the lid is fastened by crimping on the O-ring, flanging of the front-end double can edge, and creasing in front of the lid. Hereby it is ensured that the O-ring on the one hand indeed is tight, and on the other hand there results a certain mechanical stability of the ammunition, for example during handling when a cartridge drops to the ground, or simply when subjected to vibrations inside the launcher tube, for example when a tank is travelling through difficult terrain.

In a preferred embodiment, the ammunition may employ the classical technology of smoke-generating ammunition, in particular smoke cartridges, wherein a detonation separator charge, igniter means for igniting the active mass and separating the double can, as well as a delay element, in particular a pyrotechnical delay element, are provided.

It is preferred to fasten the ejection charge on the side of the partition wall facing the bottom of the launcher tube.

In a preferred embodiment, the ejection charge includes an electrically ignitable primer as well as a propellant charge powder, preferably black powder.

Inside the double can underneath the partition wall in the direction of the launcher bottom, a disc may be arranged which is provided with venting bores preferably covered with a rupture foil.

Hereby it is ensured that following ignition of the propellant charge powder, initially a sufficiently great gas pressure builds up, and the gases, following rupturing of the rupture foils, then flow out through the venting bores acting as nozzles in the direction of the launcher bottom so as to expel the ammunition from the launcher tube.

In order to ensure smooth separation with maximum possible uniformity, in a preferred embodiment of the invention predetermined breaking points are provided in the double can outer wall in the range of the active mass. These predetermined breaking points are preferably produced by notching.

If necessary, the ammunition may on the front end be provided with a protective cap extending over the launcher tube to thus serve as a protection for the ammunition and the launcher tube itself in the presence of rain and soiling, and thus ensure the functionality of the launcher system together with the ammunition under adverse climate conditions and combat conditions.

BRIEF DESCRIPTION OF THE DRAWINGS

Further advantages and features result from the description of an embodiment by referring to the drawing, wherein.

DETAILED DESCRIPTION OF THE PREFERRED EMBODIMENTS

Figure 1:
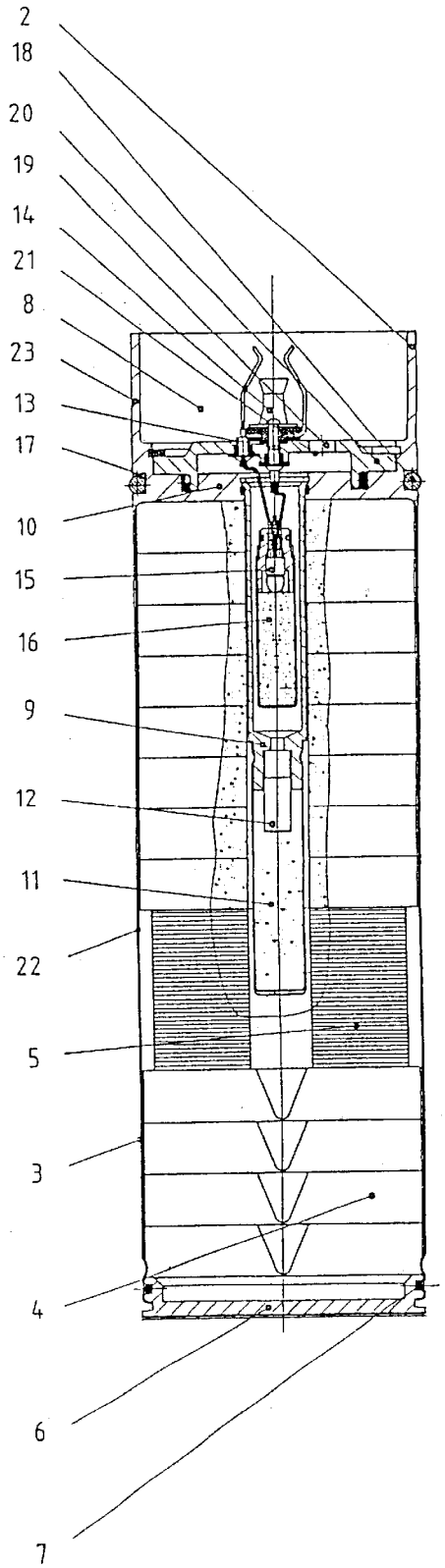
FIG. 1 shows an ammunition in accordance with the invention, having the form of an infrared-smoke cartridge.

In FIG. 1 a cartridge as ammunition for smoke generation for the protection of combat vehicles, in particular tanks, is schematically represented under 1.

The caliber of cartridge 1 is 76 mm in an exemplary case. The ammunition 1 includes a double can 2 having arranged in its large chamber 3, shown on the right in the FIGURE, active masses 4 and 5. The active mass 4 is a smoke active mass which is present in the form of a pressed article and based, e.g., on a composition as described in EP 0 046 230 A2.

A typical smoke composition may, for example, be as follows.

| | |
|---|---|
| Red phosphorus | 50–85% (wt.) |
| Potassium nitrate ($KNO_3$) | 0–24% (wt.) |
| Magnesium (Mg) | 4–25% (wt.) |
| Binder | 3–10% (wt.) |

| | |
|---|---|
| Red phosphorus (Type HB600) | 66% (wt.) |
| Potassium nitrate ($KNO_3$) | 16% (wt.) |
| Magnesium (Mg) | 12% (wt.) |
| Binder | 6% (wt.) |

The IR-active mass 5 includes flares of a circle segment shape with infrared active mass on them, wherein the infrared active mass is composed on the basis of micro-encapsulated red phosphorus.

In an exemplary case the flare active mass 5 is arranged between two layers of smoke active masses 4.

The flares form the spontaneous component of the smoke and enable building of a smoke screen within seconds. Positioning between the pressed bodies of smoke active mass ensures secure ignition.

For producing the cartridge 1, the smoke active mass 4Land the IR-active mass 5 are introduced into the double can 2, a lid 6 with the O-ring 7 is inserted into the double can and tightly closed by crimping on the O-ring 7. On the front-end side, the double can 2 is flanged and creased in front of the lid 6. Both measures serve for lid fixation.

On the side of the small chamber 8 (on the left in FIG. 1) a detonation separator charge 9 is fixed on the partition wall 10 shared by the chambers 2 and 8.

The detonation separator charge 9 contains igniter means 11 for igniting the active masses 4 and 5 and separating the double can 2.

The ignition timing is determined by a pyrotechnical delay element 12 which is ignited upon launching.

Subsequently the ejection charge 13 is fastened to the left side of the partition wall 10 in the representation of FIG. 1.

The ejection charge 13 includes electrical contact means 14, a primer 15, and a propellant charge 16 which is black powder in an exemplary case. The black powder as the propellant charge 16 delivers the necessary gas pressure for accelerating the cartridge 1 out of the launcher tube.

At the outer circumference of the double can 2, in the range of the partition wall 10, a groove 17 for receiving an O-ring 18 is turned. The O-ring 18 serves as a sabot.

When the cartridge 1 is employed, the following functions unfold:

The cartridge 1 is placed within a conventional launcher tube which is not shown in FIG. 1. By a pulse of electric current the contact means 14 ignites the primer 15 which then causes the black powder to ignite as a propellant charge 16. The hot gas ignites the delay element 12, and the gas exits into the launcher cavity through venting bores 19 in a disc 20 arranged underneath the partition wall 10 so as to expel the cartridge 1 from the launcher.

The required insulation of the black powder is achieved with the aid of a rupture foil 21 pasted over the venting bores 19 of the disc 20.

After ejection, the active mass 4 and 5 is ignited after lapse of the delay period of the delay element 12, and the double can 2 is separated in the range of the active masses 4 and 5.

In order to ensure smooth and homogeneous separation, the double can outer wall 22 is notched in four places distributed over the circumference in the range in which the active masses 4 and 5 are located, whereby predetermined breaking points are provided.

By this measure it is ensured that burning active mass fragments and metal fragments will not be hurled through the air in an uncontrolled manner to thus become a potential hazard.

Through these predetermined breaking points it is also ensured that the active masses 4 and 5 will be distributed within a controlled range, and thus a dense smoke screen may be built within the shortest possible period.

Preferably the double can outer wall 22 of the large chamber 3 of the double can 2 and the outer wall 23 of the double can 22 have different wall thicknesses, whereby the mechanical stability of the cartridge is enhanced.

In addition, the partition wall 10 also having a greater thickness moreover serves as a support for distributing the forces acting on the launcher tube during launching, because the pressure is annularly transmitted to the entire casing of the double can 22 via the partition wall 10.

It will be appreciated by those skilled in the art that the present invention can be embodied in other specific forms without departing from the spirit or essential it characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

List of Reference Numerals

1: cartridge
2: double can
3: large chamber
4: smoke active mass
5: IR-active mass
6: lid
7: O-ring
8: small chamber
9: detonation separator charge
10: partition wall
11: igniter means
12: pyrotechnical delay element
13: ejection charge
14: contact means
15: primer
16: propellant charge
17: groove
18: O-ring
19: venting bores
20: disc
21: rupture foil
22: double can outer wall, large chamber
23: double can outer wall, small chamber

What is claimed is:

1. Ammunition for smoke generation for protection of combat vehicles, including: a shell, at least one active mass arranged therein, at least one detonation separator charge, at least one ejection charge for ejecting said ammunition from a launcher tube, and electrical contact means for igniting said ejection charge, wherein said shell is formed as an integral two-chamber double can having a partition wall shared by both chambers, wherein a wall thickness of said partition wall is greater than a wall thickness of an outer wall of said double can, and an end of said double can located in a direction of a front-end launcher tube muzzle is closed gas-tight.

2. Ammunition in accordance with claim 1, wherein said double can is formed of a synthetic material or metal.

3. Ammunition in accordance with claim 2, wherein said double can is made of an extruded metal.

4. Ammunition in accordance with claim 1, wherein said active mass includes smoke-generation pressed bodies and IR radiation emitting flares.

5. Ammunition in accordance with claim 2, wherein said double can is formed of aluminum or its alloys or wrought alloys.

6. Ammunition in accordance with claim 5, wherein said lid is fixed by crimping on said O-ring, flanging of the front-end double can end, and creasing in front of the lid.

7. Ammunition in accordance with claim 6, wherein said detonation separator charge includes igniter means for igniting said active mass and separating said double can, as well as a delay element.

8. Ammunition in accordance with claim 7, wherein said ejection charge is fastened on the side of said partition wall facing a launcher tube bottom.

9. Ammunition in accordance with claim 8, wherein said ejection charge includes an electrically ignitable primer as well as a propellant charge powder.

10. Ammunition in accordance with claim 9, wherein inside said double can underneath said partition wall in the direction of the launcher tube bottom, a disc having venting bores is arranged.

11. Ammunition in accordance with claim 10, wherein said venting bores are covered with rupture foil.

12. Ammunition in accordance with claim 11, wherein predetermined breaking points are provided in said double can outer wall in a range of said active mass.

13. Ammunition in accordance with claim 12, wherein on the front end thereof a protective cap extending over the launcher tube is provided.

14. Ammunition in accordance with claim 1, wherein said active mass includes smoke-generation pressed bodies and IR radiation emitting flares.

15. Ammunition in accordance with claim 1, wherein said double can is closed on its front-end side with a lid sealed by an O-ring.

16. Ammunition in accordance with claim 15, wherein said lid is fixed by crimping on said O-ring, flanging of the front-end double can end, and creasing in front of the lid.

17. Ammunition in accordance with claim 1, wherein said detonation separator charge includes igniter means for igniting said active mass and separating said double can, as well as a delay element.

18. Ammunition in accordance with claim 1, wherein said ejection charge is fastened on a side of said partition wall facing a launcher tube bottom.

19. Ammunition in accordance with claim 1, wherein said ejection charge includes an electrically ignitable primer as well as a propellant charge powder.

20. Ammunition in accordance with claim 1, wherein inside said double can underneath said partition wall in a direction of a launcher tube bottom, a disc having venting bores is arranged.

21. Ammunition in accordance with claim 20, wherein said venting bores are covered with rupture foil.

22. Ammunition in accordance with claim 1, wherein predetermined breaking points are provided in said double can outer wall in a range of said active mass.

23. Ammunition in accordance with claim 1, wherein on the front end thereof a protective cap extending over the launcher tube is provided.

24. Ammunition for smoke generation for protection of combat vehicles, including: a shell, at least one active mass arranged therein, at least one detonation separator charge, at least one ejection charge for ejecting said ammunition from a launcher tube, and electrical contact means for igniting said ejection charge, wherein said shell is formed as an integral two-chamber double can having a partition wall shared by both chambers, wherein a wall thickness of said partition wall is greater than a wall thickness of an outer wall of said double can, wherein an end of said double can located in a direction of a front-end launcher tube muzzle is closed gas-tight with a lid fixed by crimping on an O-ring, flanging of the front-end double can end, and creasing in front of the lid, and wherein inside said double can underneath said partition wall in a direction of the launcher tube bottom, a disc having venting bores is arranged, wherein said venting bores are covered with rupture foil.

25. Ammunition for smoke generation for protection of combat vehicles, including:

a shell, at least one active mass arranged therein, at least one detonation separator charge, at least one ejection charge for ejecting said ammunition from a launcher tube, and electrical contact means for igniting said ejection charge, wherein said shell is formed as an integral two-chamber double can having a partition wall shared by both chambers, wherein a wall thickness of said partition wall is greater than a wall thickness of an outer wall of said double can, and an end of said double can located in a direction of a front-end launcher tube muzzle is closed gas-tight, wherein said double can is made of an extruded metal, wherein said active mass includes smoke-generation pressed bodies and IR radiation emitting flares, and wherein said double can is closed on its front-end side with a lid sealed by an O-ring.

26. Ammunition in accordance with claim 7, wherein said delay element is a pyrotechnical delay element.

27. Ammunition according to claim 5, wherein said double can is formed of copper and/or zinc and/or magnesium and/or silicon and/or manganese.

* * * * *